US008123590B2

(12) United States Patent
MacKinnon

(10) Patent No.: US 8,123,590 B2
(45) Date of Patent: Feb. 28, 2012

(54) DOUBLE-LAYER FABRIC GARMENT AND PRODUCTION METHOD

(75) Inventor: Debra MacKinnon, Easton, PA (US)

(73) Assignee: Zephyrs, Spring Lake, NJ (US)

( * ) Notice: Subject to any disclaimer, the term of this patent is extended or adjusted under 35 U.S.C. 154(b) by 1200 days.

(21) Appl. No.: 11/893,282

(22) Filed: Aug. 14, 2007

(65) Prior Publication Data

US 2008/0034476 A1 Feb. 14, 2008

Related U.S. Application Data

(60) Provisional application No. 60/838,205, filed on Aug. 14, 2006.

(51) Int. Cl.
*A41C 1/00* (2006.01)
*A41D 1/06* (2006.01)

(52) U.S. Cl. ..... 450/96; 2/228

(58) Field of Classification Search ..... 2/227, 228, 2/238, 400–403, 406, 239, 409, 243.1, 69, 2/67, 73, 72; 450/96, 106, 100; 66/175, 66/172 E, 172 R, 173, 177, 171, 198, 176
See application file for complete search history.

(56) References Cited

U.S. PATENT DOCUMENTS 3,678,514 A * 7/1972 Safrit ..... 2/212
4,872,324 A * 10/1989 Rearwin et al. ..... 66/172 E
5,052,058 A * 10/1991 Mueller ..... 2/228
5,517,832 A * 5/1996 Kristensen ..... 66/177
5,553,468 A * 9/1996 Osborne ..... 66/171
5,746,068 A * 5/1998 Popa et al. ..... 66/176
5,836,179 A * 11/1998 van Laar ..... 66/171
5,978,971 A * 11/1999 Wald ..... 2/403
6,009,558 A * 1/2000 Rosch et al. ..... 2/212
6,125,664 A * 10/2000 Browder, Jr. ..... 66/176
6,164,094 A * 12/2000 Lonati et al. ..... 66/172 R
6,178,784 B1 * 1/2001 Marley, Jr. ..... 66/173
7,024,892 B2 4/2006 Blakely
7,549,302 B2 6/2009 Duckham et al.
7,654,115 B2 2/2010 Duckham et al.

OTHER PUBLICATIONS

"Take a Power Trip with the Latest Hosiery Innovation", Jun. 11, 2010, downloaded from http://press.spanx.com/pr/spanx/spx/take-a-power-trip-with-the-latest-160155.aspx on Jul. 6, 2010.

* cited by examiner

*Primary Examiner* — Gloria Hale
(74) *Attorney, Agent, or Firm* — McDermott Will & Emery LLP

(57) ABSTRACT

Described is a double-layer fabric garment. The garment is formed of a tubular fabric element that comprises a first portion and a second portion. The first portion includes an initial edge portion. The second portion has specific areas of fabric with increased compression strength and an end portion. The initial edge of the first portion is connected with the end portion of the second portion, thereby creating a space between the first portion and the second portion and forming a seamless double-layer fabric garment. Thus, the first portion operates as an outer fabric layer and the second portion operates as an inner fabric layer, whereby the specific areas of fabric with increased compression strength of the second portion provide an increased shaping effect to a user while wearing the double-layer fabric garment. Therefore, the inner fabric layer provides a shaping effect while concealed by the overlaid outer layer.

20 Claims, 6 Drawing Sheets

112
204
202
200

204
202

102
206
400
210
104
404
402

100
406

102
104
112
402

100

DOUBLE-LAYER FABRIC GARMENT AND PRODUCTION METHOD

PRIORITY CLAIM

The present application is a non-provisional patent application, claiming the benefit of priority of U.S. Provisional Application No. 60/838,205, filed on Aug. 14, 2006, titled, "Double Fabric Garment and Production Method."

BACKGROUND OF THE INVENTION (1) Technical Field

The present invention relates to the field of apparel and, more specifically, to a garment having a double-layer of fabric that provides a body support and shaping effect when worn by a user.

(2) Background

Knitwear garments for shaping the body are well known in the art. Many existing knitwear garments (e.g., leggings, shorts, pants, etc.) are made with specific weaves to provide an overall shaping effect. These garments (sometimes referred to as shaping garments) typically provide a shaping effect by utilizing a single layer of a stretch knit fabric with targeted areas of compression strength. Thus, when wearing traditional shaping garments, the targeted compression areas are plainly visible in the garment.

Further, most shaping garments are unattractive. The garments typically have seams that are visible on the external surface of the garment. Such seams are not desirable as they are visible when worn underneath clothing. The visible seams thereby indicate, contrary to the user's intentions, that the user is using a shaping garment underneath his or her external clothing.

Existing garments that provide a shaping effect and are meant to be worn underneath external clothing also possess tight bands that compress the body and create an unnatural and pinched shape on the user's body. For example, shapewear that is meant to support the thigh and buttock areas (that are cut off at just above the knee) are often finished with an elasticized band. The band typically squeezes the leg just above the knee, which pinches the leg and provides an unnatural, bulging shape on the leg. As a result, an indentation formed by the compression is visible underneath the user's pants or skirt. Contrary to what is currently available, a user desires a garment that is cut off above the knee and maintains the smooth appearance of his or her leg. Thus, it is desirable to wear a shaping garment that conceals the fact that the shaping garment is worn underneath the external clothing.

Thus, a continuing need exists for a shaping garment with both a seamless, enhanced natural appearance and an improved shaping function.

SUMMARY OF THE INVENTION

The present invention relates to a double-layer fabric garment. The garment is formed of a tubular fabric element comprising a first portion and a second portion. The first portion includes an initial edge portion. The second portion includes specific areas of fabric with increased compression strength and an end portion. The initial edge of the first portion is folded toward the end portion of the second portion, thereby creating a space between the first portion and the second portion, and forming a seamless double-layer fabric garment where the first portion operates as an outer fabric layer and the second portion operates as an inner fabric layer. Thus, the specific areas of fabric with increased compression strength of the second portion provide an increased shaping effect to a user while wearing the double-layer fabric garment.

Additionally, the specific areas of fabric with increased compression strength are comprised of bands of spandex placed in the second portion to target a user's body parts to provide a shaping effect when the garment is worn.

Furthermore, the inner fabric layer and outer fabric layer are woven in a single tubular piece, substantially overlaid without restriction, thereby creating an inter-space between the outer fabric layer and inner fabric layer. The layers are attached at a certain point (e.g., waistband) with each other so that the targeted areas of spandex of the inner fabric layer provide an increased shaping effect to a user while wearing the double-layer fabric garment.

Additionally, in another aspect, the inner fabric layer and outer fabric layer are knitted in a single, tubular piece.

In another aspect, the double-layer fabric garment is formed in a garment form selected from a group consisting of shorts, pants, leggings, and hosiery.

In yet another aspect, the double-layer fabric garment further comprises a crotch portion inserted within the second portion when the double-layer fabric garment is formed in a garment form selected from a group consisting of shorts, pants, legging, and hosiery.

In another aspect, an elastic edge portion can also be included.

Additionally, the double-layer fabric garment is formed in the shape of pants and further includes a band of spandex attached with the garment such that when worn by a user, the band of spandex surrounds a user's buttocks. Furthermore, it can be formed such that the band of spandex surround the user's thighs or stomach (i.e., tummy) regio.

In yet another aspect, the inner fabric layer is made of targeted areas of spandex and a stretch material selected from a group consisting of nylon, microfiber, cotton, jersey knit, smooth knit, ribbed knit, patterned knit, natural yarn, synthetic yarn, elasticized material and spandex.

Additionally, the outer fabric layer is made of a stretch material selected from a group consisting of nylon, microfiber, cotton, jersey knit, smooth knit, ribbed knit, patterned knit, natural yarn, synthetic yarn, elasticized material and spandex.

In yet another aspect, the present invention also comprises a method for forming the double-layer fabric garment described herein. The method comprises an act of forming a tubular fabric element having a first portion and a second portion that includes targeted areas of a stretch knit fabric. The first portion is folded along (e.g., over) the second portion so that both portions are overlaid. The overlaid first portion and the second portion are cut to remove superfluous fabric and to create the double-layer fabric garment. The first portion is attached with the second portion in at least one area, whereby the double-layer fabric garment is created in its final form and shape.

In another aspect, the tubular fabric element further comprises markings to provide reference points for overlaying the first fabric portion and second fabric portion in a correct position.

Finally, the tubular fabric element further comprises markings to provide reference points for cutting the first portion and second portion to result in a correct form.

BRIEF DESCRIPTION OF THE DRAWINGS

The objects, features and advantages of the present invention will be apparent from the following detailed descriptions of the disclosed aspects of the invention in conjunction with reference to the following drawings, where.

DETAILED DESCRIPTION

Figure 1A:
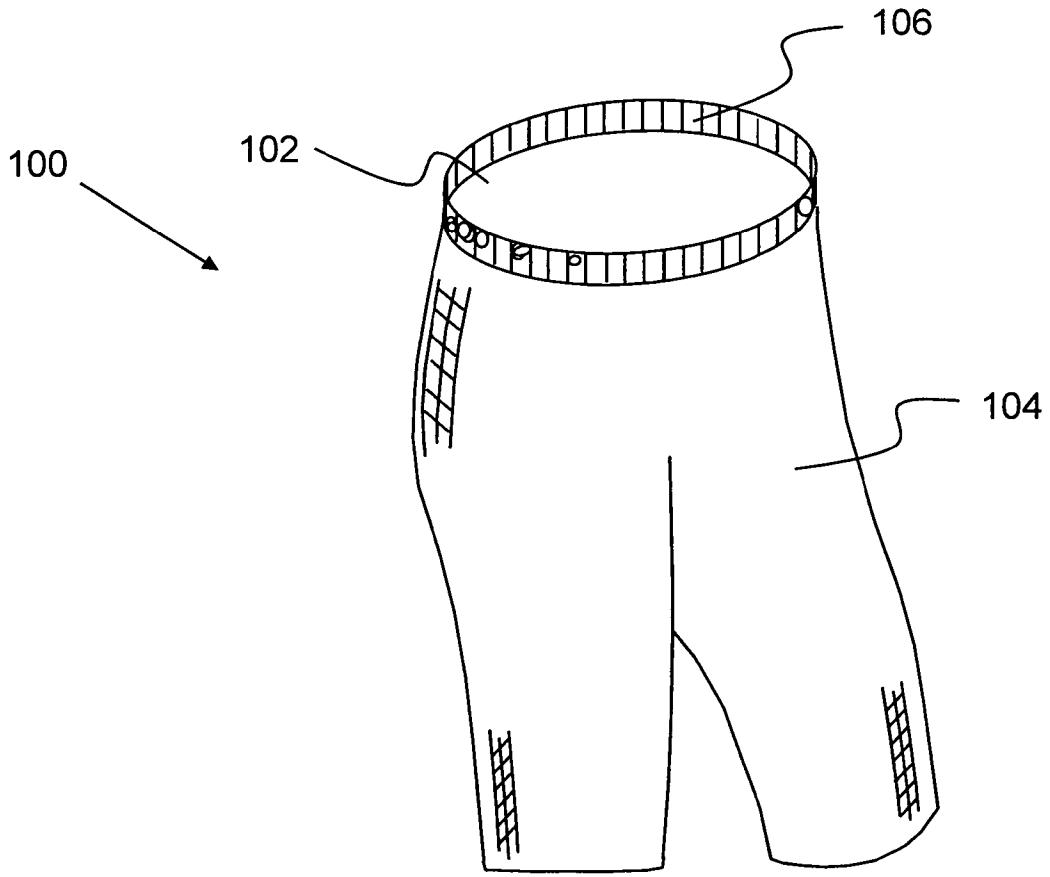
FIG. 1A is a front elevational-view of a double-layer fabric garment according to the present invention.

The present invention relates to the field of apparel and, more specifically, to a garment having a double-layer of fabric that provides a body support and shaping effect when worn by a user. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein. Furthermore, it should be noted that unless explicitly stated otherwise, the figures included herein are illustrated diagrammatically and without any specific scale, as they are provided as qualitative illustrations of the concept of the present invention.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in an illustrative form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Please note, if used, the labels left, right, front, back, top, bottom, forward, reverse, clockwise and counter clockwise have been used for convenience purposes only and are not intended to imply any particular fixed direction. Instead, they are used to reflect relative locations and/or directions between various portions of an object.

(1) Specific Aspects

The present invention relates to a garment having a double-layer of fabric that provides a support and shaping effect when worn by a user. In particular, the double-layer fabric garment may be used for athletic and fitness activities. However, the invention is not intended to be limited thereto as it may be worn and used as a supportive or shaping garment on a daily basis and/or for a variety of activities. Thus, the garment can be formed in any suitable manner to provide a support and shaping effect to a user, a non-limiting example of which includes leg wear, such as pants, shorts, leggings, and hosiery.

To provide the shaping effect, the garment is comprised of two fabric layers; an inner fabric layer in contact with the user's body and an outer fabric layer attached therewith. The inner and outer fabric layers are manufactured using yarns that are identical or different, natural or synthetic, in accordance with the final supportive effect that is desired by a user. A variety of yarns are used to obtain different properties, appearance, and garment weight according to the intended use of the garment. For example, the internal fabric layer can be made of a microfiber and the external fabric layer of cotton, or vice versa. Additionally, the external fabric layer can be made of a smooth, ribbed, patterned, or raised design fabric to enhance, customize or improve the appearance of the garment.

In one aspect, the inner fabric layer is comprised of a stretch knit fabric and bands of spandex that are placed in targeted areas of the layer to provide a control and shaping effect to specific parts of the body, including tummy and thigh control. As a non-limiting example, the bands of spandex can be formed in the inner fabric layer such that they wrap around a user's buttocks when the garment is worn, thereby shaping and lifting the buttocks. As another example, the bands of spandex or otherwise compressively formed yarn can be formed to control the user's tummy and/or thigh areas.

The outer fabric layer possesses a uniform stretch knit fabric to provide the garment a more aesthetically pleasing outer appearance. As a result, the garment provides a structured knit feature from its inner fabric layer to provide the shaping, control, and push-up effect, while maintaining a pleasant external appearance due to its outer fabric layer.

FIG. 1A is an illustration of a double-layer fabric garment 100 according to the present invention. Although illustrated as pants, the invention is applicable to any other type of garments such as shorts, leggings, and hosiery, wherein the inner layer of the garments have characteristics and properties that are different from the outer layer of the garment.

More specifically, the double-layer fabric garment 100 is comprised of an inner fabric layer 102, in one type of stretch knit fabric, and an outer fabric layer 104, made from the same or another type of stretch knit fabric. In particular, the inner fabric layer 102 is comprised of stretch knit fabric plus bands of spandex 106 to provide a desired shaping effect. The stretch knit fabric is any suitable fabric that has stretching and retracting (compression) properties, non-limiting examples of which include Lycra™ and Spandex™.

Figure 1B:
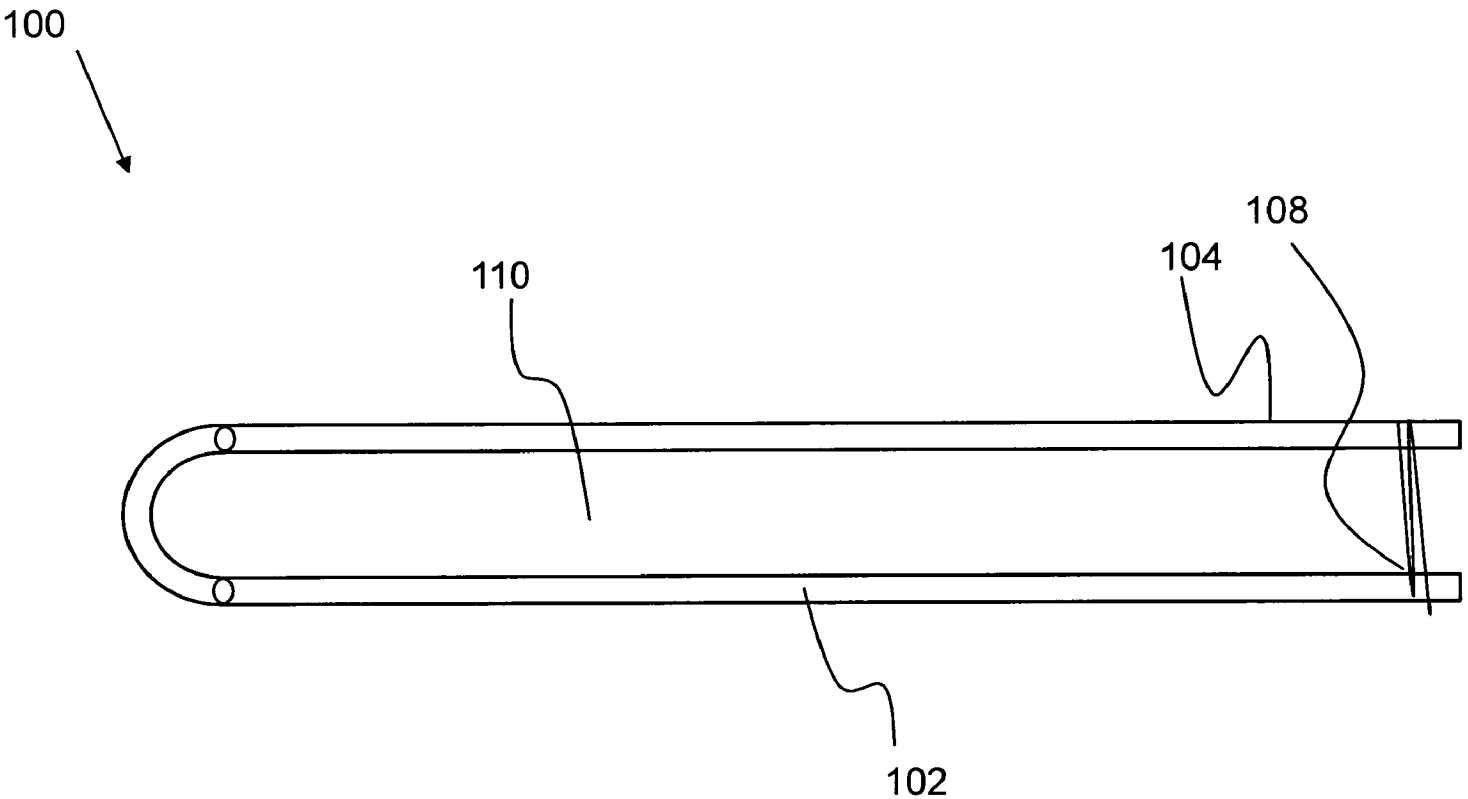
FIG. 1B is a cross-sectional view of the double-layer fabric garment according to the present invention.

FIG. 1B is a cross-sectional view of the double-layer fabric garment 100 according to the present invention. As shown in FIG. 1B, the inner fabric layer 102 and the outer fabric layer 104 are overlaid with one another. Although overlaid, the inner and outer fabric layers 102 and 104 are not connected in their entirety as they are attached only in certain points 108 according to necessity, such as a waist band area of the garment. Such a configuration creates an inter-space 110 between the two layers 102 and 104 of fabrics that contribute towards maintaining an ideal microclimate for the user's well-being in any type of environment. If elasticized materials are used for both fabrics, this will accentuate the compression strength, since the action of both fabrics will be combined. Further, the perspiration formed against the inner fabric layer 102 tends to be absorbed by the outer fabric layer 104, thus maintaining the fabric in contact with the skin, dryer and more comfortable. The double-layer also increases the consistency of the garment, making it warmer in the winter and eliminating any effect of transparency. Moreover, in one aspect of the present invention, the garment is made in a material with breathable and anti-bacterial properties that is suitable for warming muscles.

Figure 1C:
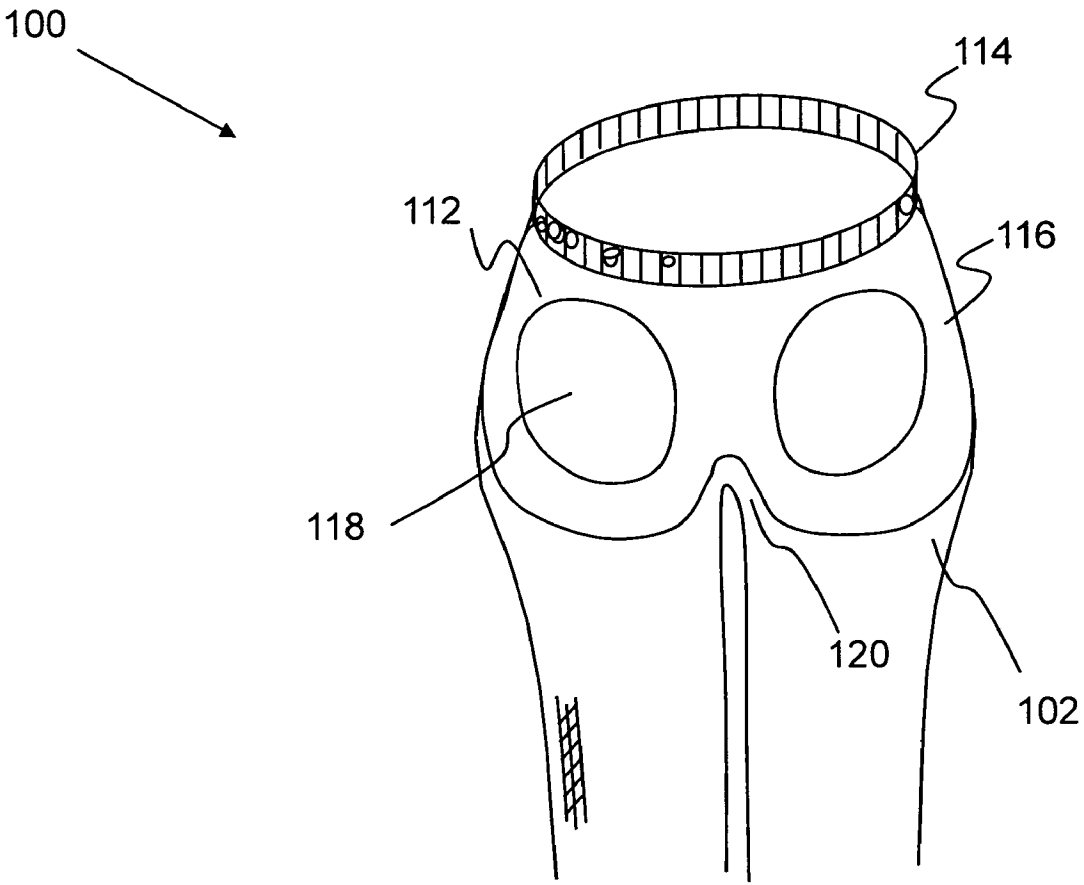
FIG. 1C is a rear elevational-view of double-layer fabric garment according to the present invention, illustrating targeted areas of a stretch knit fabric.

In one aspect of the present invention, the garment is in the form of pants, shorts, or leggings. As described above, the garment is formed to provide a support and shaping effect. By shaping the stretch knit material into a band, the garment 100 can effectively target a particular area of a user's body to provide the shaping effect for. Such an example is illustrated in FIG. 1C. FIG. 1C illustrates a garment turned inside out to display the inner fabric layer 102. As shown, the inner fabric layer 102 is designed with bands 112 of spandex (or other stretch knit material) in certain areas of the garment 100 to create a shaping effect in any suitable area, non-limiting examples of which include the abdominal 114, thigh 116 and buttock 118 areas. In this form, the crotch area 120 of the garment 100 can incorporate a piece of fabric in natural fiber. Either one or both of the inner and outer fabric layers can be formed to include targeted areas of stretch knit material. As illustrated in FIG. 1C, the bands 112 are formed such that they provide a compression effect against the targeted area. For example, the band 112 around the abdominal area 114 squeezes-in a user's abdominal tissue. Alternatively, due to its compression abilities, the band 112 around the buttocks 118 reshapes the buttocks from their natural condition into a more aesthetically desirable shape. The bands 112 are one of several power bands knitted in to various strategic positions within the shorts (on the inner layer only), creating zones of contraction which lift buttocks, flatten tummy and reduce thighs. Another novel feature of the present invention is that these power bands 112 are disguised by the double-layer, so that no-one except the wearer is aware of these support features. Thus, the garment (e.g., shorts) according to the present invention brings glamour to a Shapewear market that is dominated by unattractive girdle type construction which leaves no doubt that the wearer is wearing a slimming garment. Additionally, the construction of the secret inner layer is unique to the industry. The only similar product is produced by Spanx™ and called Power Panties™. The Spanx™ product is not "seamless" (i.e., it has a center, back, and front seam) and while it also has two layers, neither of the layers offer the spandex power bands of support.

Figure 2:
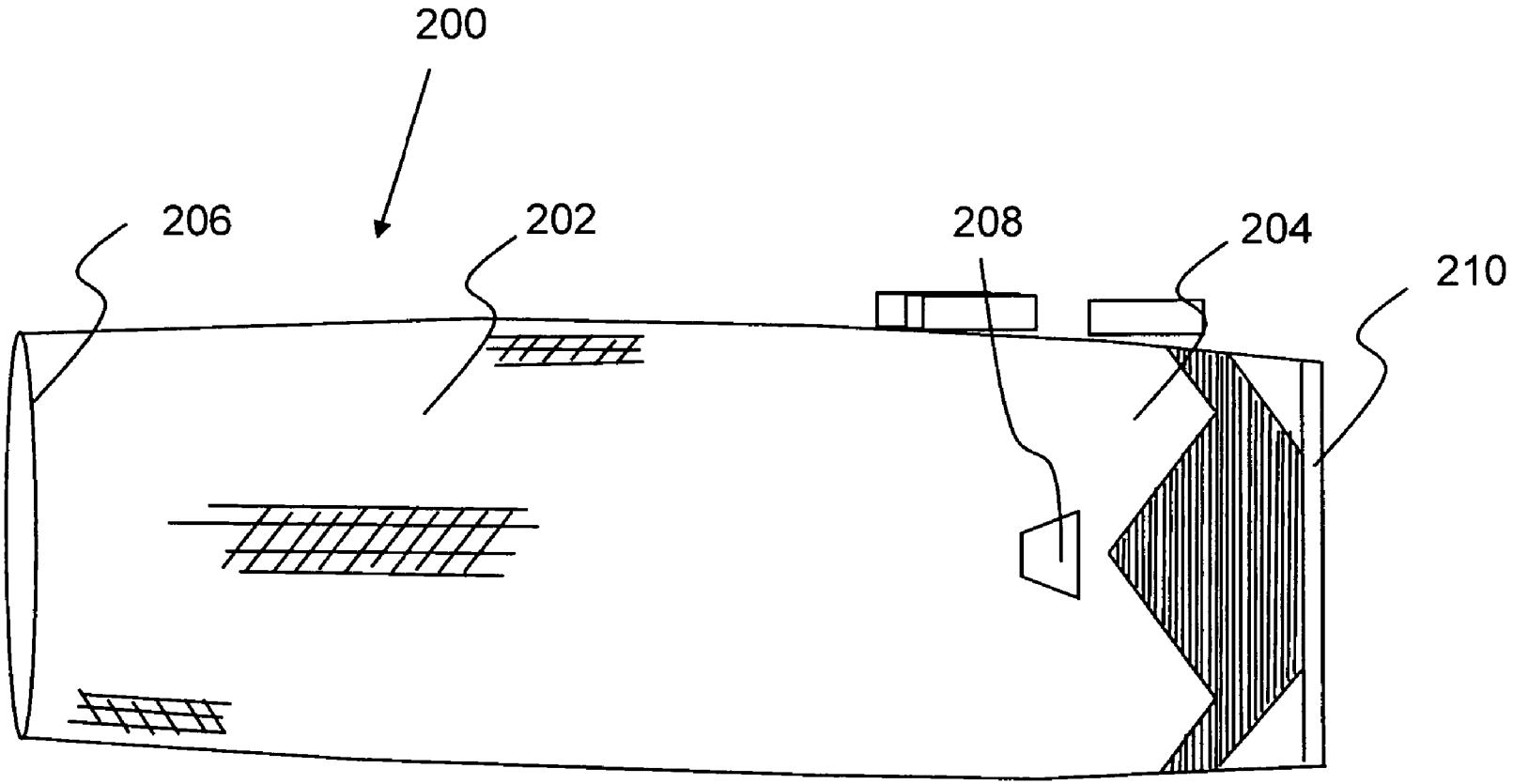
FIG. 2 is a front-view of fabric used to construct a double-layer fabric garment according to the present invention.

In constructing the double-layer fabric garment 100, the garments typically include a tubular fabric element that when worn, wraps around a portion of the user's body. FIG. 2 illustrates a front-view of a tubular fabric element 200 that is used to construct a double-layer fabric garment in accordance with the present invention. The double-layer fabric garment is knitted on a small-diameter circular jersey knitwear machine. Such a machine is able to produce a seamless tubular fabric element 200, which includes all the aspects required and necessary for the finished element.

A desirable production method for a garment according to the present invention, initiates with the construction of a tubular fabric element 200 having a first portion 202 (that corresponds with the outer fabric layer 104 of FIG. 1) and a second portion 204 (that corresponds with the inner fabric layer 102 of FIG. 1).

The tubular fabric also comprises an initial edge section 206 of the first portion 202 and an end section 210 of the second portion 204. In the case of pants, leggings, shorts, and hosiery, a crotch piece 208 may also be inserted.

Figure 3:
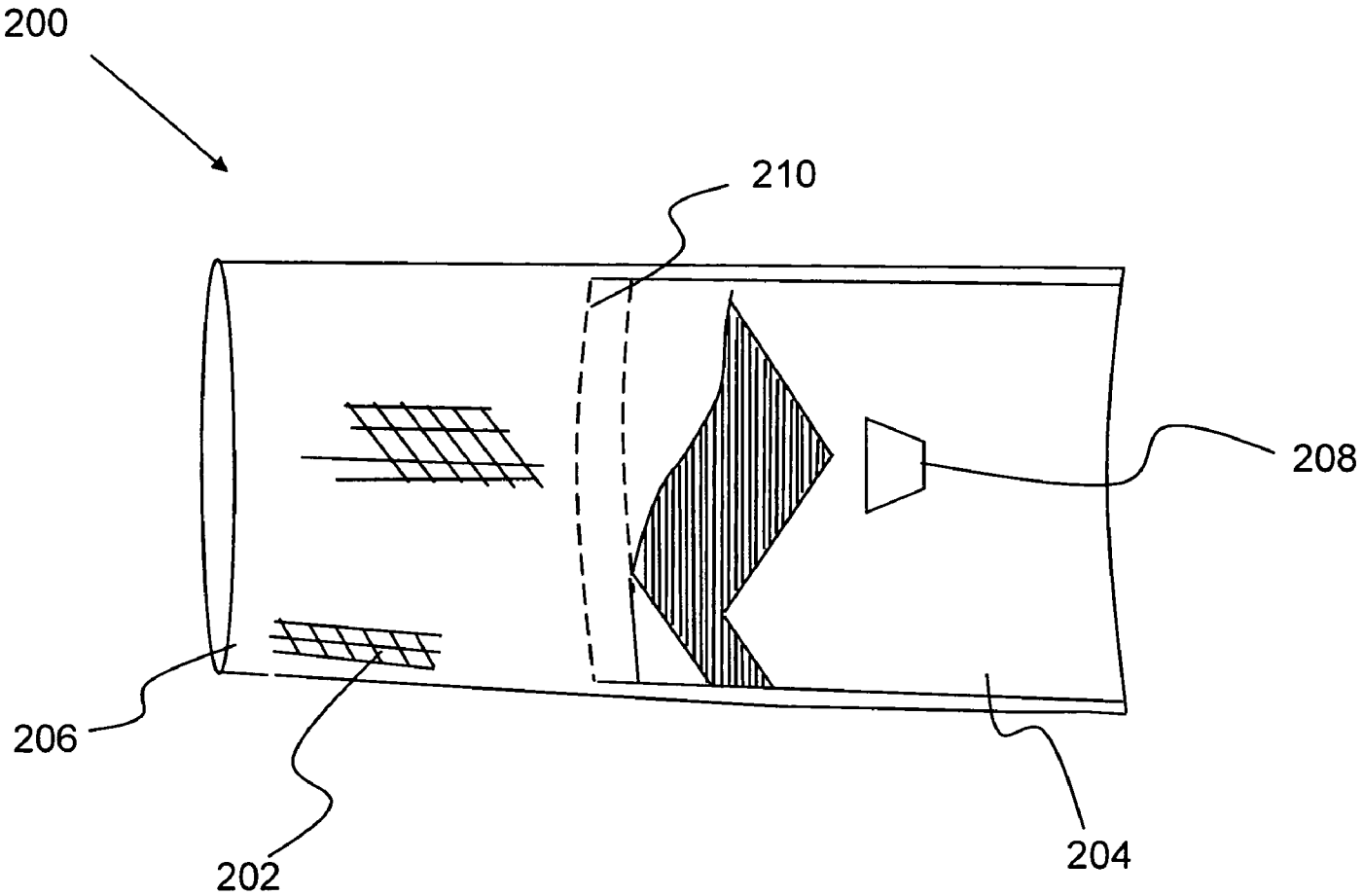
FIG. 3 is a front-view of an intermediate stage of a double-layer fabric garment according to the present invention.

FIG. 3 illustrates an intermediate stage of a tubular fabric element 200 for use in a double-layer fabric garment. To assemble the garment, the second portion 204 of the tubular element is turned inside the first portion 202, so that the two corresponding inner and outer fabric layers are overlaid. Or alternatively, the first portion 202 is pulled up and over the second portion 204. In either case, this results in an inner fabric layer and an outer fabric layer. This occurs when the end portion 210 of said second portion 204 is led to the initial edge portion 206 of the first portion 202. The two layers are connected to create the desired form of the garment, cut in a suitable manner to remove any superfluous fabric. The two layers are then sewn together along the cut line to form the final shape of the garment, thereby also forming a space (i.e., inter-space) between the two fabric layers. The two fabrics are then sewn together using any suitable connection technique. As a non-limiting example, the two fabric layers are connected using four needle seaming, which provides comfort to the wearer because it does not include overlapped or excess fabric and, therefore, does not leave marks on the users body from seam lines. Additionally, the garment is made on seamless machinery, where the only seam line is on the inside leg of the garment. Thus, together with the power bands, the seamless construction helps to create a smoothing slimming shape.

Figures 4A, 4B, 4C, 4D, 4E:
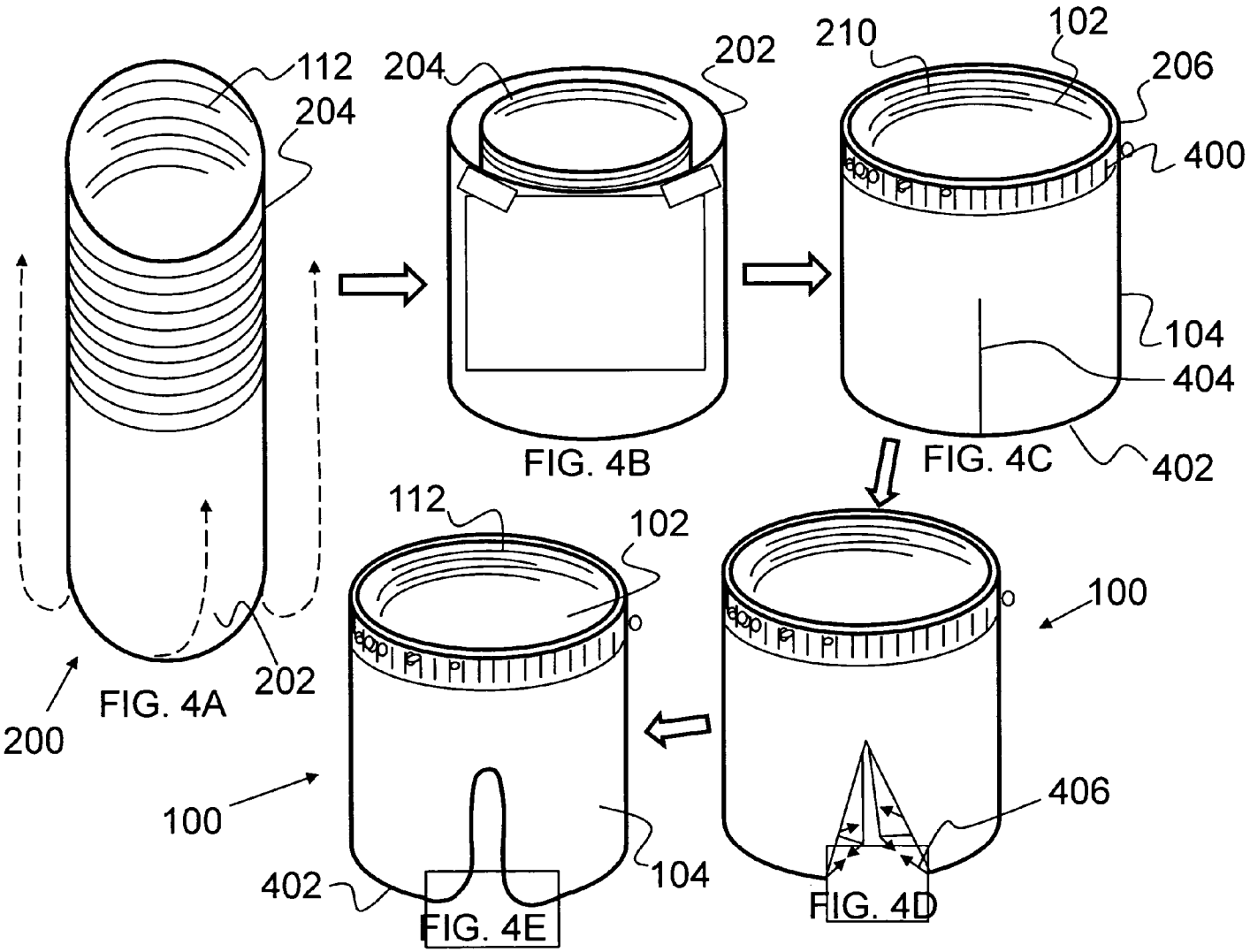
FIG. 4A is an illustration of a tubular fabric element according to the present invention.
FIG. 4B is an illustration of a first portion of the tubular fabric element being pulled over a second portion of the tubular fabric element.
FIG. 4C is an illustration of an inner fabric layer and an outer fabric layer according to the present invention.
FIG. 4D is an illustration of various portions of the fabric layers being connected according to the present invention.
FIG. 4E is an illustration of a double-layer fabric garment according to the present invention.

As another example and for further illustration, FIGS. 4A through 4E illustrate a procedure for forming the double-layer garment 100. As shown in FIG. 4A, the procedure uses a tubular fabric element 200 that includes a first portion 202 and a second portion 204. The second portion 204 includes areas of fabric with increased compression strength, such as bands 112 or similar configurations. Alternatively, the first portion 202 is smooth and does not include stitching or otherwise bulky indicia. As shown in FIGS. 4A and 4B, the first portion 202 is folded up and over the second portion 204. Thus, as shown in FIG. 4C, the second portion now becomes an inner fabric layer 102 with the first portion operating as an outer fabric layer 104. The end portion 210 and the initial edge portion 206 can then be attached with one another to form a waist band area 400 of the garment 100. An elastic edge portion can also be formed in the waist band area 400. As noted in the illustrations, by folding the first portion 202 over the second portion 204, a bottom edge 402 of the garment 100 is effectively a seamless edge, thereby providing a smooth surface for the user. Finally, a cut 404 can made to shape the garment and allow for the formation of legs or other appendages, according to the final design of the garment 100. As shown in FIG. 4D, the various layers of the garment 100 are thereafter attached 406 to form the final design. As noted above, the layers are attached using any suitable technique, a non-limiting example of which includes four needle seaming. Finally, as illustrated in FIG. 4E, the garment 100 includes a secret inner layer 102 that includes areas of increased compression strength (e.g., power bands 112), an outer layer 104 that is smooth to conceal the power bands 112, and a seamless bottom edge 402.

To make these operations easier during construction, the tubular fabric element can be marked with different textures or yarns to provide reference points for correct coupling of both fabrics. The manufacturing procedure for other garments of different shapes will be identical, except that the sewn seams will be created in appropriate areas according to garment shape and the specific areas of spandex in the inner fabric layer are placed in targeted areas in order to create the desired supportive effect.

In conclusion, the present invention is a double-layer garment that is formed by rolling a tubular fabric element up and over itself to form in inner layer and an outer layer. The inner layer provides a hidden functionality in that it includes areas of fabric with increased compression strength to provide a slimming effect. Further, the outer layer is smooth which hides the functionality of the secret inner layer. Finally, the garment is seamless because its end is formed by folding the tube up and over the inner layer. Thus, a user can confidently wear a slimming garment with the knowledge that its functionality is hidden within an inner fabric layer.

What is claimed is:

1. A double-layer fabric garment comprising:

a tubular fabric element comprising a first portion and a second portion;

the first portion having an initial edge portion; and the second portion having specific areas of fabric with increased compression strength and an end portion, wherein the initial edge of the first portion is connected with the end portion of the second portion, thereby creating a space between the first portion and the second portion, and forming a double-layer fabric garment where the first portion operates as an outer fabric layer and the second portion operates as an inner fabric layer, whereby the specific areas of fabric with increased compression strength of the second portion provide an increased shaping effect to a user while wearing the double-layer fabric garment, and wherein the garment is leg wear having a seamless bottom edge, and a seam line is only on an inside leg of the garment.

2. A double-layer fabric garment as set forth in claim 1, wherein the specific areas of fabric with increased compression strength are comprised of bands of spandex placed in the second portion to target a user's body parts to provide a shaping effect when the garment is worn.

3. A double-layer fabric garment as set forth in claim 2, wherein the inner fabric layer and outer fabric layer are knitted in a single tubular piece, substantially overlaid without restriction, creating an inter-space between the outer fabric layer and inner fabric layer, and attached at a waist band area, whereby the targeted areas of spandex of the inner fabric layer provide an increased shaping effect to a user while wearing the double-layer fabric garment.

4. A double-layer fabric garment as set forth in claim 3, wherein the double-layer fabric garment is leg wear selected from a group consisting of shorts, pants, leggings, and hosiery.

5. A double-layer fabric garment as set forth in claim 4, wherein the double-layer fabric garment further comprises a crotch portion inserted within the second portion.

6. A double-layer fabric garment as set forth in claim 5, further comprising an elastic edge portion connected with the initial edge and the end portion.

7. A double-layer fabric garment as set forth in claim 6, wherein the double-layer fabric garment is formed in the shape of pants and further includes a band of spandex attached with the garment such that when worn by a user, the band of spandex surrounds an area of a user selected from a group consisting of the user's buttocks, the user's tummy, and the user's thigh area.

8. A double-layer fabric garment as set forth in claim 6, wherein the inner fabric layer is made of targeted areas of spandex and a stretch material selected from a group consisting of nylon, microfiber, cotton, jersey knit, smooth knit, ribbed knit, patterned knit, natural yarn, synthetic yarn, elasticized material and spandex.

9. A double-layer fabric garment as set forth in claim 1, wherein outer fabric layer is made of a stretch material selected from a group consisting of nylon, microfiber, cotton, jersey knit, smooth knit, ribbed knit, patterned knit, natural yarn, synthetic yarn, elasticized material and spandex.

10. A double-layer fabric garment as set forth in claim 1, wherein the inner fabric layer and outer fabric layer are knitted in a single tubular piece, substantially overlaid without restriction, creating an inter-space between the outer fabric layer and inner fabric layer, and attached at a waist band area, whereby the targeted areas of spandex of the inner fabric layer provide an increased shaping effect to a user while wearing the double-layer fabric garment.

11. A double-layer fabric garment as set forth in claim 1, wherein the inner fabric layer and outer fabric layer are knitted using dissimilar fabrics.

12. A double-layer fabric garment as set forth in claim 1, wherein the double-layer fabric garment is leg wear selected from a group consisting of shorts, pants, leggings, and hosiery.

13. A double-layer fabric garment as set forth in claim 1, wherein the double-layer fabric garment further comprises a crotch portion inserted within the second portion when the double-layer fabric garment is leg wear selected from a group consisting of shorts, pants, legging, and hosiery.

14. A double-layer fabric garment as set forth in claim 1, further comprising an elastic edge portion connected with the initial edge and end portion.

15. A double-layer fabric garment as set forth in claim 1, wherein the double-layer fabric garment is formed in the shape of pants and further includes a band of spandex attached with the garment such that when worn by a user, the band of spandex surrounds an area of a user selected from a group consisting of the user's buttocks, the user's tummy, and the user's thigh area.

16. A method for forming a double-layer fabric garment, comprising acts of: forming a tubular fabric element having a first portion and a second portion that includes targeted areas of a stretch knit fabric; folding the first portion along the second portion so that both portions are overlaid; cutting the overlaid first portion and the second portion to remove superfluous fabric and to create the double-layer fabric garment; and attaching the first portion with the second portion in at least one area, whereby the double-layer fabric garment is created in its final form and shape, and wherein the garment is leg wear having a seamless bottom edge, and a seam line is only on an inside leg of the garment.

17. A method as set forth in claim 16, wherein the tubular fabric element further comprises markings to provide reference points for overlaying the first fabric portion and second fabric portion in a correct position.

18. A method as set forth in claim 17, wherein the tubular fabric element further comprises markings to provide reference points for cutting the first portion and second portion to result in a correct form.

19. A method as set forth in claim 16, wherein the tubular fabric element further comprises markings to provide reference points for cutting the first portion and second portion to result in a correct form.

20. A double-layer fabric garment as set forth in claim 1, wherein the garment is formed from a tubular fabric element rolled up an over itself to provide the seamless bottom edge.

* * * * *